US005133096A

United States Patent [19]

Neumann

[11] Patent Number: 5,133,096

[45] Date of Patent: Jul. 28, 1992

[54] PLURALITY OF SEPARABLE SECTIONS FORMING ANTIDECUBITAL BASE

[76] Inventor: Aleksander Neumann, ul. Andersena 61, 60-193 Poznań, Poland

[21] Appl. No.: 564,396

[22] Filed: Aug. 8, 1990

[30] Foreign Application Priority Data

Aug. 11, 1989 [PL] Poland ..... W88073

[51] Int. Cl.[5] ..... A47C 27/00

[52] U.S. Cl. ..... 5/465; 5/468; 5/461

[58] Field of Search ..... 5/448, 468, 465, 461, 5/470, 441, 437

[56] References Cited

U.S. PATENT DOCUMENTS

| | | | |
|---|---|---|---|
| 2,548,547 | 4/1951 | Melrose | 5/465 |
| 2,552,476 | 5/1951 | Barton | 5/448 |
| 3,451,071 | 6/1969 | Whiteley | 5/465 |
| 3,840,923 | 10/1974 | Bos | 5/468 |
| 4,459,714 | 7/1984 | Lin | 5/441 |
| 4,631,765 | 12/1986 | Casey | 5/465 |
| 4,878,258 | 11/1989 | Casey | 5/465 |

FOREIGN PATENT DOCUMENTS

| | | | |
|---|---|---|---|
| 265570 | 10/1968 | Austria | 5/441 |
| 2328279 | 6/1973 | Fed. Rep. of Germany . | |

*Primary Examiner*—Renee S. Luebke
*Assistant Examiner*—F. Saether
*Attorney, Agent, or Firm*—Ladas & Parry

[57] ABSTRACT

An antidecubital mat for bedridden patients, comprising individual basic elements that are air permeable and can be joined together to vary the size and shape of the mat. Each basic element has the shape of a rectangular cushion with recessed side corners and a hole defined therein. Along the sides of each basic element press studs and VELCRO-type band fasteners are provided which enables individual basic elements to be joined together to form the mat.

7 Claims, 2 Drawing Sheets

PLURALITY OF SEPARABLE SECTIONS FORMING ANTIDECUBITAL BASE

BACKGROUND OF THE INVENTION

The subject of the invention is an antidecubital mat of covering designed for patients confined to the bed for a long time.

The antidecubital beds and mattresses used so far are made from various types of fabrics and materials such as linen, frotte, synthetic and rubber fabric, or rubber from which pulsatory mattresses are produced. Those mattresses are of rectangular shape and are segmented into pockets of various shapes and sizes, and are filled with materials such as granulated styropiane, polystyrene, wooden balls or similar materials which meet the condition of proper access of air to the skin of a patient. All those anti-decubital beds and mattresses have their fixed shape and indivisible size, the proportion of their length and width are dictated by the particular manufacturer.

When such a bed or a mattress is wetted or stained with excreta or physiological liquids, the whole bed must be replaced with a clean one. Washing it, because of the dirty contents of the pockets, is very difficult or practically impossible even if the purpose is not its sterility but simply cleaning and using it again.

SUMMARY OF THE INVENTION

The aim of this invention is to overcome those disadvantages. The aim has been achieved by designing an antidecubital mat or covering comprising individual basic elements which can be connected in various ways to adjust the shape and size of the mat or covering.

The basic element has the shape of a rectangular cushion with straight or semicircularly recessed corners, and has a hole centrally located about the axis of symmetry. The basic element is made of cotton and 75% of the basic element is filled in with foamed polystyrene. To enable individual basic elements to be joined together, each basic element has press studs and VELCRO-type band fasteners arranged along its rim.

The advantage of this invention besides the advantages which result from the similar type of mattresses and beds, is that in case of staining it can be very easily replaced with new and clean elements but only those basic elements which have been stained and need washing or sterilisation when they are used in post-operating or intensive therapy rooms. When the staining cannot be cleaned, only the stained part of the base must be replaced, so the loss is much smaller than in case of replacing the whole bed or the mattress. The basic element can be easily washed and desinfected and can be produced also in the sterile version. It is easy to store the basic elements of the antidecubital mat or covering, and each basic element can be used separately.

BRIEF DESCRIPTION OF THE DRAWINGS

The antidecubital mat or covering is presented in the enclosed drawings where.

DESCRIPTION OF THE PREFERRED EMBODIMENT

Figure 1:
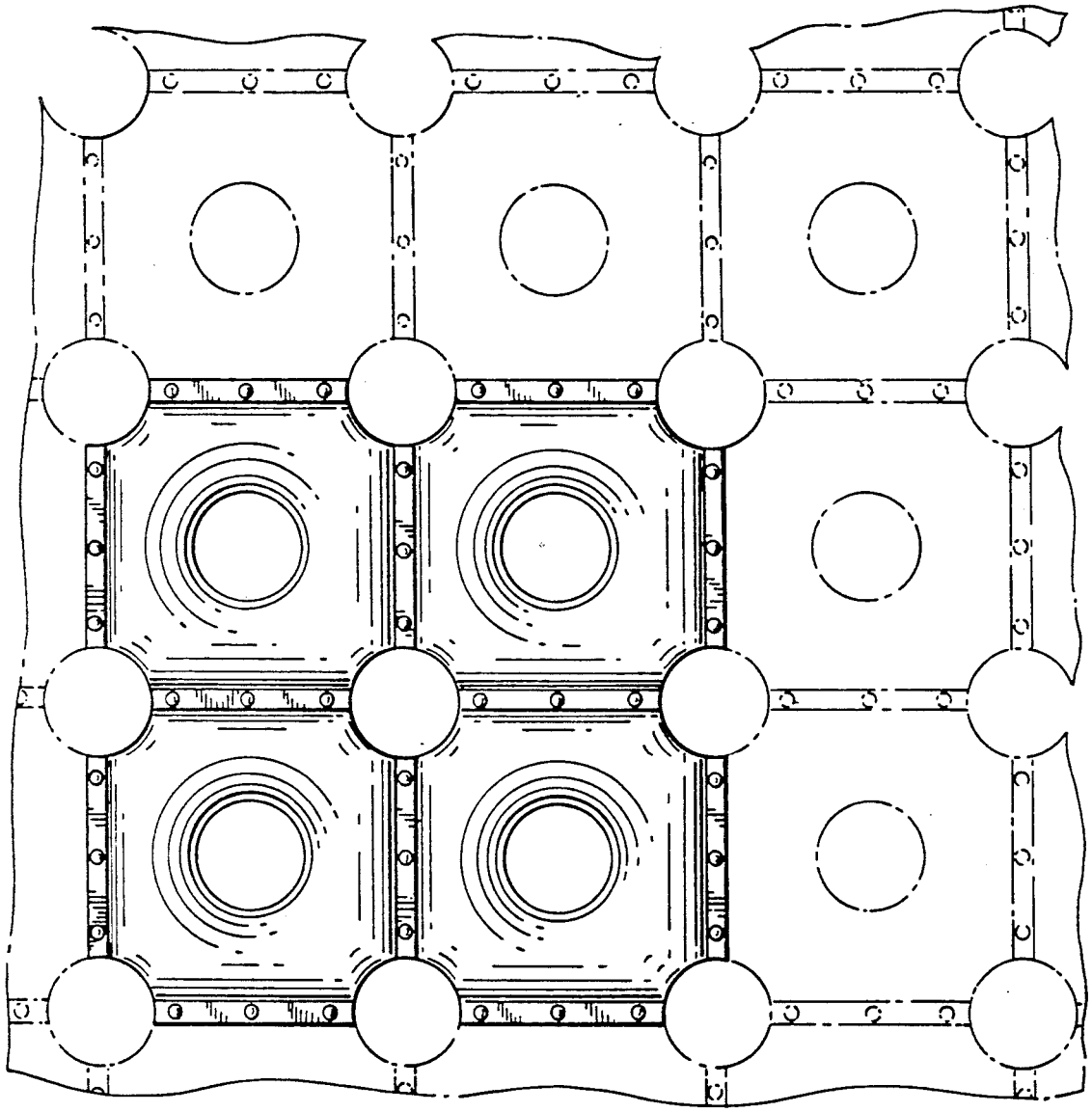
FIG. 1 shows the view of the antidecubital mat or covering consisting of basic elements and FIG. 2 shows a plan view of the basic element.
Figure 2:
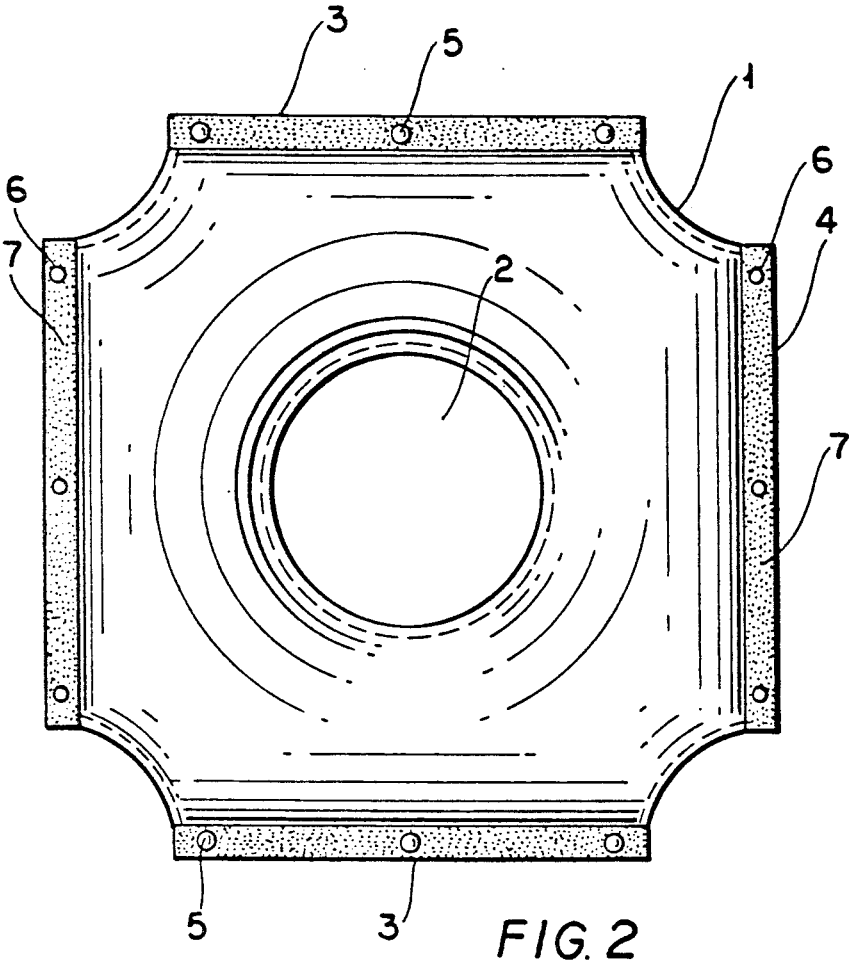
Figure 3:
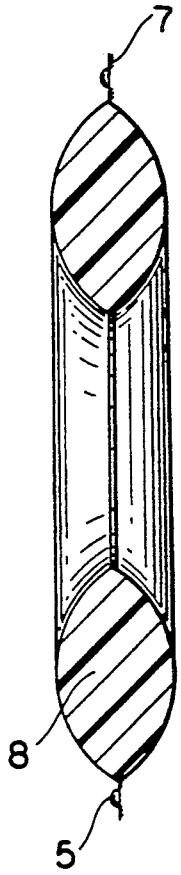
FIGS. 3 and 4 show sectional views of the basic element.
Figure 4:
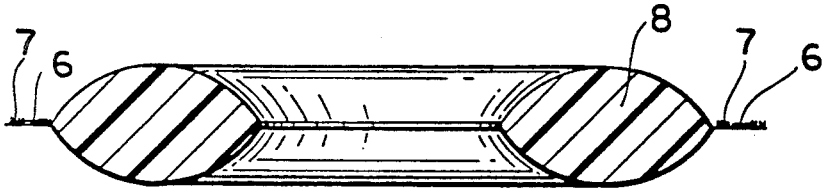

The basic element of the antidecubital mat or covering shown in FIGS. 2–4 has the shape of a rectangular cushion with straight or semicircularly recessed corners 1, made from cotton fibre, filled with granulate of foamed polystyrene 8, having in the centre of symmetry the hole 2 which diameter equals ½ of the straight line of the shorter side 3 or 4, with press studs which upper parts 5 are arranged on the rims of the sides 3 and lower parts 6 of these press studs on the opposite sides 4. The sides 3 and 4 of the basic element have on the entire length of their rims the band fastener of the Velco types 7 placed on the opposite side of upper parts of press studs 5 and on the side of their lower parts 6.

Figure 5:
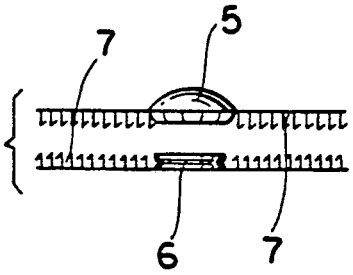
FIG. 5 shows the arrangement of upper and lower parts of the press studs and band fasteners of the VELCRO type.

Thanks to this arrangement of upper 5 and lower 6 parts of press studs and band fastener of the Velco type 7, shown in FIG. 5, it is possible to join the basic elements of the antidecubital mat or covering together and in this way to obtain any required shape and size of the mat or covering.

I claim:

1. An antidecubital mat for bedridden patients, comprising individual basic elements that are air permeable and can be joined together to vary the size and shape of the mat, wherein each said basic element has the shape of a rectangular cushion with recessed side corners and a hole defined therein, and wherein said basic element has connecting means about each side of the basic element so that individual basic elements can be joined together to form said mat such that said recessed corners come together to form an opening.

2. The antidecubital mat according to claim 1, wherein said hole is centrally located about an axis of symmetry of said basic element, and wherein the diameter of said hole is half the length of a side of said basic element.

3. The antidecubital mat according to claim 2, wherein said connecting means includes press studs on the sides of the basic element.

4. The antidecubital mat according to claim 3, wherein said connecting means includes VELCRO-type fasteners on the sides of the basic element.

5. The antidecubital mat according to claim 4, wherein 75% of said basic element is filled in with granular foamed polystyrene material.

6. The antidecubital mat according to claim 1, wherein said recess is in the shape of a straight line.

7. The antidecubital mat according to claim 1, wherein said recess is semicircularly in shape.

* * * * *